US009368874B2

(12) United States Patent
Kim et al.

(10) Patent No.: US 9,368,874 B2
(45) Date of Patent: Jun. 14, 2016

(54) LOG-PERIODIC DIPOLE ARRAY ANTENNA AND SMART SKIN HAVING THE SAME

(71) Applicants: Min Sung Kim, Daejeon (KR); Chan Yik Park, Daejeon (KR); Byung Gil Yu, Seongnam-si (KR); Ho Joon Jang, Seongnam-si (KR)

(72) Inventors: Min Sung Kim, Daejeon (KR); Chan Yik Park, Daejeon (KR); Byung Gil Yu, Seongnam-si (KR); Ho Joon Jang, Seongnam-si (KR)

(73) Assignee: AGENCY FOR DEFENSE DEVELOPMENT, Daejeon (KR)

( * ) Notice: Subject to any disclaimer, the term of this patent is extended or adjusted under 35 U.S.C. 154(b) by 225 days.

(21) Appl. No.: 14/011,875

(22) Filed: Aug. 28, 2013

(65) Prior Publication Data

US 2014/0232605 A1 Aug. 21, 2014

(30) Foreign Application Priority Data

Feb. 15, 2013 (KR) ..... 10-2013-0016466

(51) Int. Cl.

| | |
|---|---|
| ***H01Q 11/10*** | (2006.01) |
| ***H01Q 5/00*** | (2015.01) |
| ***H01Q 1/28*** | (2006.01) |
| ***H01Q 1/42*** | (2006.01) |
| ***H01Q 15/10*** | (2006.01) |
| ***H01Q 5/307*** | (2015.01) |

(52) U.S. Cl.

CPC ..... *H01Q 11/105* (2013.01); *H01Q 1/28* (2013.01); *H01Q 1/286* (2013.01); *H01Q 1/42* (2013.01); *H01Q 5/307* (2015.01); *H01Q 15/10* (2013.01)

(58) Field of Classification Search

CPC ..... H01Q 11/10; H01Q 11/105; H01Q 1/40; H01Q 1/405; H01Q 1/27; H01Q 1/28; H01Q 1/281; H01Q 1/282; H01Q 1/283; H01Q 1/286; H01Q 1/287; H01Q 19/04; H01Q 19/28; H01Q 19/30; H01Q 19/32; H01Q 5/321; H01Q 5/378; H01Q 5/385; H01Q 5/48; H01Q 5/49; H01Q 13/28

USPC ..... 343/705, 792.5

See application file for complete search history.

(56) References Cited

U.S. PATENT DOCUMENTS

| | | | | |
|---|---|---|---|---|
| 3,163,864 | A * | 12/1964 | Greenberg | 343/809 |
| 3,369,243 | A * | 2/1968 | Greiser | 343/770 |
| 5,323,170 | A * | 6/1994 | Lang | 343/872 |
| 6,175,336 | B1 * | 1/2001 | Coughlin et al. | 343/708 |

(Continued)

OTHER PUBLICATIONS

Kim, J. et al., "Structural Design of Korea Aero-Vehicle Smart Skin Antenna (KASSA)", Advances in Structural Health Management and Composite Structures 2012, Annual meeting of the Korean Ceramic Society published on Aug. 29, 2012.

(Continued)

*Primary Examiner* — Sue A Purvis
*Assistant Examiner* — Patrick Holecek
(74) *Attorney, Agent, or Firm* — Scully Scott Murphy and Presser; Edward Grolz

(57) ABSTRACT

A log-periodic dipole array antenna according to one exemplary embodiment of the present disclosure includes a dielectric substrate, a radiating element having a plurality of lines extending from a center to an outer side and symmetrically arranged on the dielectric substrate based on the center, so as to resonate in a first frequency band and a second frequency band, the plurality of lines being connected at the center or the outer side of the radiating element in an alternating manner, the lines becoming longer going from up to down of the radiating element fed according to a predetermined log-periodic ratio, and a band stopper formed on one point for connecting the lines to each other.

15 Claims, 7 Drawing Sheets

(56) References Cited

U.S. PATENT DOCUMENTS

| | | | | |
|---|---|---|---|---|
| 7,253,777 | B2 * | 8/2007 | Blaschke et al. | 343/713 |
| 2007/0089285 | A1 * | 4/2007 | Utecht et al. | 29/600 |

OTHER PUBLICATIONS

Kim, Y.S. et al., "Design of Compact Wideband Clas for Aircraft Communication", Advances in Structural Health Management and Composite Structures 2012, Annual meeting of the Korean Ceramic Society published on Aug. 29, 2012.

Kim, Min Sung et al., "Design and Experimental Validation of a Conformal Load-Bearing Antenna Structure", Advances in Structural Health Management and Composite Structures 2012, Annual meeting of the Korean Ceramic Society published on Aug. 29, 2012.

* cited by examiner

PRIOR ART

LOG-PERIODIC DIPOLE ARRAY ANTENNA AND SMART SKIN HAVING THE SAME

CROSS-REFERENCE TO RELATED APPLICATION

Pursuant to 35 U.S.C. §119(a), this application claims the benefit of earlier filing date and right of priority to Korean Application No. 10-2013-0016466, filed on Feb. 15, 2013, the contents of which is incorporated by reference herein in its entirety.

BACKGROUND OF THE DISCLOSURE

1. Field of the Disclosure

This specification relates to a log-periodic dipole array antenna for transmission and reception of wireless signals.

2. Background of the Disclosure

In general, an antenna switches an electrical signal which is represented with voltage/current and an electromagnetic wave represented with an electric field/magnetic field to each other. Types of antennas include a dipole antenna, a monopole antenna, a patch antenna, a horn antenna, a parabolic antenna, a helical antenna, a slot antenna, a log-periodic dipole array (LPDA) antenna and the like.

Here, the LPDA antenna is a type that periodically repeats the impedance and radiating characteristics for the frequency. The LPDA antenna is regarded as a frequency-independent antenna owing to insignificant variation of the characteristics over the frequency band. The LPDA is wisely used as a TV reception antenna or a communication antenna in terms of broadband characteristic and proper gain. Types of broadcast and communication services, including IMT-2000, a wireless LAN, a portable wireless Internet and the like, are much diversified in recent time. Therefore, needs of antennas which can cover a wide frequency band, a dual-band, a triple-band and the like are more increasing. This further increases utilization of the LPDA antenna.

The LPDA antennas may be classified into a sawtooth-type planar antenna, a sawtooth-type trapezoidal antenna, a trapezoidal wire antenna, a zigzag-type wire antenna and the like, according to the repetitive structure. The related art LPDA antenna has a broadband characteristic and may transmit and receive a frequency of a current antenna only when its size is about two times greater than the size of the current antenna. Also, due to the broadband characteristic of the LPDA antenna, a filter circuit has to be additionally mounted to selectively use a user-desired frequency. This causes an additional cost increase and an increase in weight and size of a system.

SUMMARY OF THE DISCLOSURE

Therefore, an aspect of the detailed description is to provide a log-periodic dipole array (LPDA) antenna having a different structure from the related art antenna.

Another aspect of the detailed description is to provide a log-periodic dipole array (LPDA) antenna having a more improved structure and a better antenna performance.

To achieve these and other advantages and in accordance with the purpose of this specification, as embodied and broadly described herein, there is provided a log-periodic dipole array antenna including a dielectric substrate, a radiating element having a plurality of lines extending from a center to an outer side and symmetrically arranged on the dielectric substrate based on the center, so as to resonate in a first frequency band and a second frequency band, the plurality of lines being connected at the center or the outer side of the radiating element in an alternating manner, the lines becoming longer going from up to down of the radiating element fed according to a predetermined log-periodic ratio, and a band stopper formed on one point for connecting the lines to each other.

In accordance with one exemplary embodiment, the radiating element may include a first connector configured to connect the lines at the center of the radiating element, and a second connector configured to connect the lines at the outer side of the radiating element. The band stopper may extend from the first connector toward the outer side.

In accordance with one exemplary embodiment, the band stopper may be provided in plurality.

In accordance with one exemplary embodiment, the band stoppers may be symmetrically arranged based on the center of the radiating element.

In accordance with one exemplary embodiment, the first frequency band may be higher than the second frequency band, and the band stopper may be located adjacent to an upper side of the radiating element to reduce antenna gain with respect to a signal adjacent to the first frequency band.

In accordance with one exemplary embodiment, the first frequency band may be higher than the second frequency band, and the band stopper may be located adjacent to a lower side of the radiating element so as to reduce antenna gain with respect to the second frequency band.

In accordance with one exemplary embodiment, the radiating element may be formed on one surface of the dielectric substrate, and a reflector may be disposed on another surface of the dielectric substrate to adjust a pattern of a radio frequency signal radiated from the radiating element.

A log-periodic dipole array antenna in accordance with at least one exemplary embodiment may improve qualities of signals associated with characteristics of reflection loss and gain in a desired frequency band, and allow for reduction of weight and size of a system by virtue of non-use of an additional filter circuit.

BRIEF DESCRIPTION OF THE DRAWINGS

The accompanying drawings, which are included to provide a further understanding of the disclosure and are incorporated in and constitute a part of this specification, illustrate exemplary embodiments and together with the description serve to explain the principles of the disclosure.

In the drawings.

DETAILED DESCRIPTION OF THE DISCLOSURE

Description will now be given in detail of a log-periodic dipole array antenna according to the exemplary embodiments, with reference to the accompanying drawings. Hereinafter, suffixes "module" and "unit or portion" for components used herein in description are merely provided only for facilitation of preparing this specification, and thus they are not granted a specific meaning or function. Hence, it should be noticed that "module" and "unit or portion" can be used together. For the sake of brief description with reference to the drawings, the same or equivalent components will be provided with the same reference numbers, and description thereof will not be repeated. The expression in the singular form in this specification will cover the expression in the plural form unless otherwise indicated obviously from the context.

Figure 1:
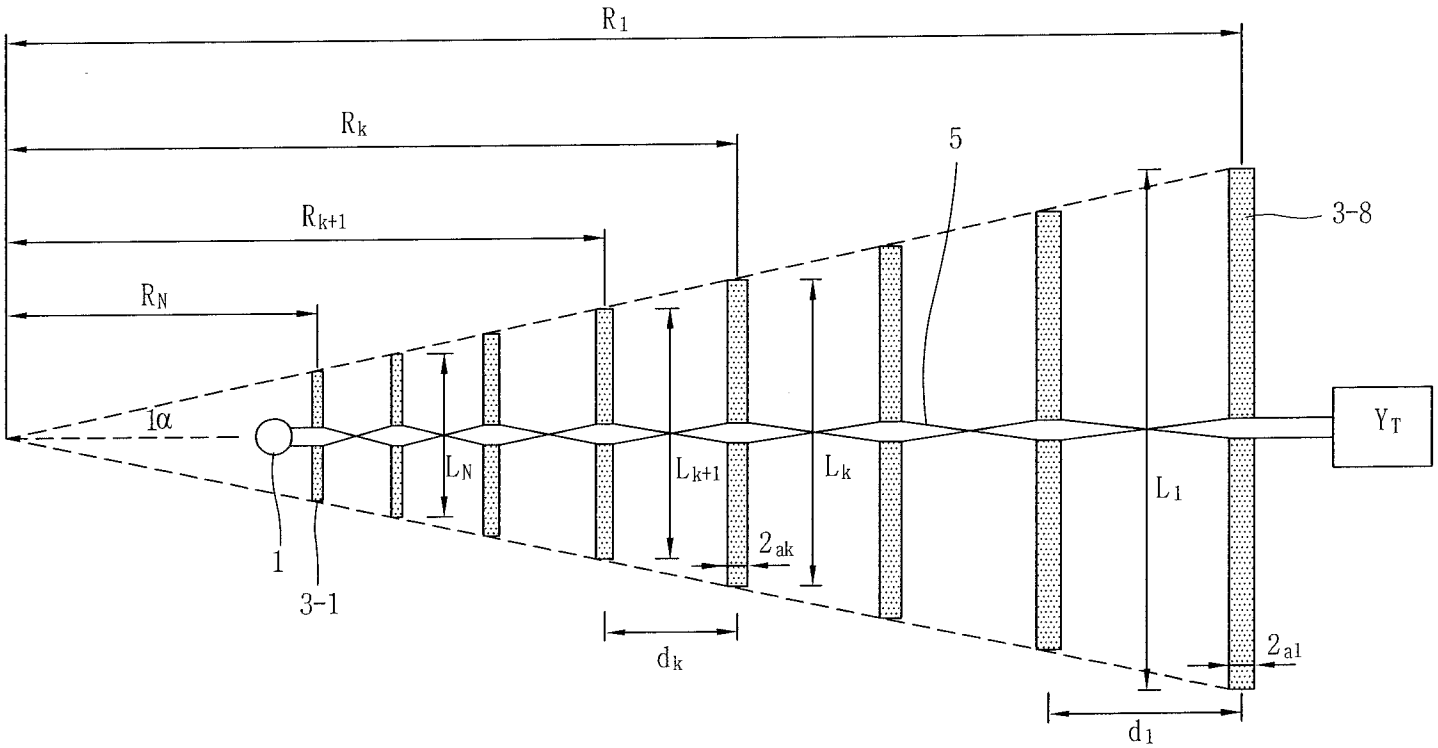
FIG. 1 is a conceptual view of a conventional log-periodic dipole array antenna related to an exemplary embodiment of the present disclosure.

FIG. 1 illustrates the structure and design parameters a conventional log-periodic dipole array antenna.

A conventional log-periodic dipole array antenna may have a radiating element on a substrate. A detailed structure will now be described. The conventional log-periodic dipole array antenna may include N dipole elements 3-1 to 3-8, which are vertically arranged with a constant interval based on both log-periodic ratio $\tau$ and scaling constant $\phi$. The dipole elements 3-1 to 3-8 may be designed so as to become longer going from left to right. Feeding may be performed to each dipole element from a feeding point 1 on the top, and a feeding signal may be transmitted through a parallel transmission line (boom) 5.

As illustrated in FIG. 1, reference symbol $a_k$ denotes a radius of each of the dipole elements 3-1 to 3-8, $L_k$ denotes a length of each of the dipole elements 3-1 to 3-8, $d_k$ denotes an interval between two dipole elements 3-1 to 3-8, and $Y_T$ denotes a terminal admittance. Structural constants imparting the log-periodic characteristics may include the log-periodic ratio $\tau$ determining the lengths of the dipole elements 3-1 to 3-8, and the scaling constant $\phi$ determining the interval, as defined in the following formulas.

$$\tau = \frac{L_{k+1}}{L_k} = \frac{a_{k+1}}{a_k}\frac{R_{k+1}}{R_k} = \frac{d_{k+1}}{d_k}$$

$$(k = 1, 2, 3, \ldots, n-1)$$

$$\sigma = \frac{d_k}{2L_k} = \frac{1}{4}(1-\tau)\cot a$$

where $R_k$ denotes a distance from the top of the log-periodic dipole antenna to the $k^{th}$ element, and $a_k$ denotes a half-flare angle of the log-periodic dipole antenna.

The antenna should have an additional filter circuit for selectively using a user-desired frequency due to the broadband characteristic of the antenna. This may cause increases in a fabricating cost of the antenna and size and weight of the antenna.

An antenna according to the present disclosure is implemented to overcome such drawbacks. The antenna may include a band stopper so as to improve the antenna characteristic in a specific frequency band even without use of a filter.

The antenna according to the present disclosure may be mounted in an aircraft, and more particularly, integrally formed with a skin which forms a surface of the aircraft.

Hereinafter, description will be given of a log-periodic dipole array antenna in accordance with an exemplary embodiment of the present disclosure with reference to FIGS. 2 to 7, and a smart skin of an aircraft having the antenna with reference to FIG. 8.

Figure 2:
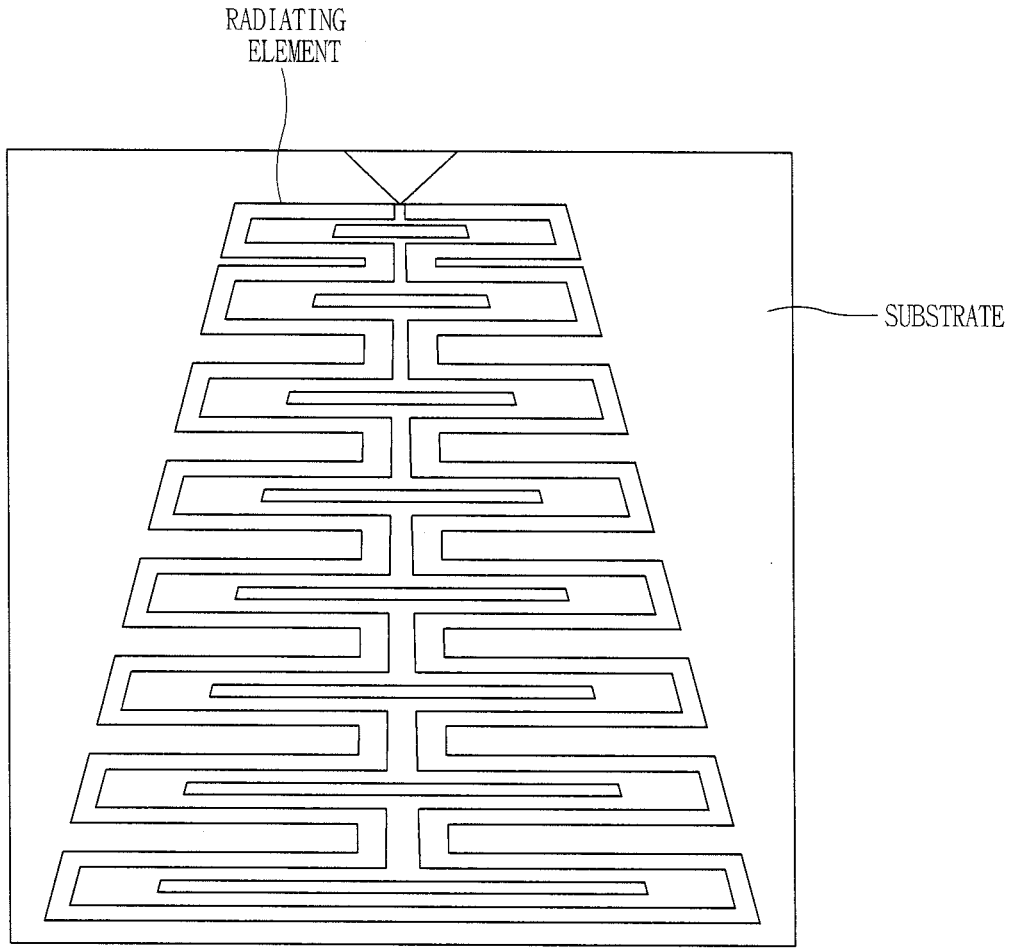
FIG. 2 is a conceptual view illustrating a structure of a log-periodic dipole array antenna having a reflector.
Figure 3:
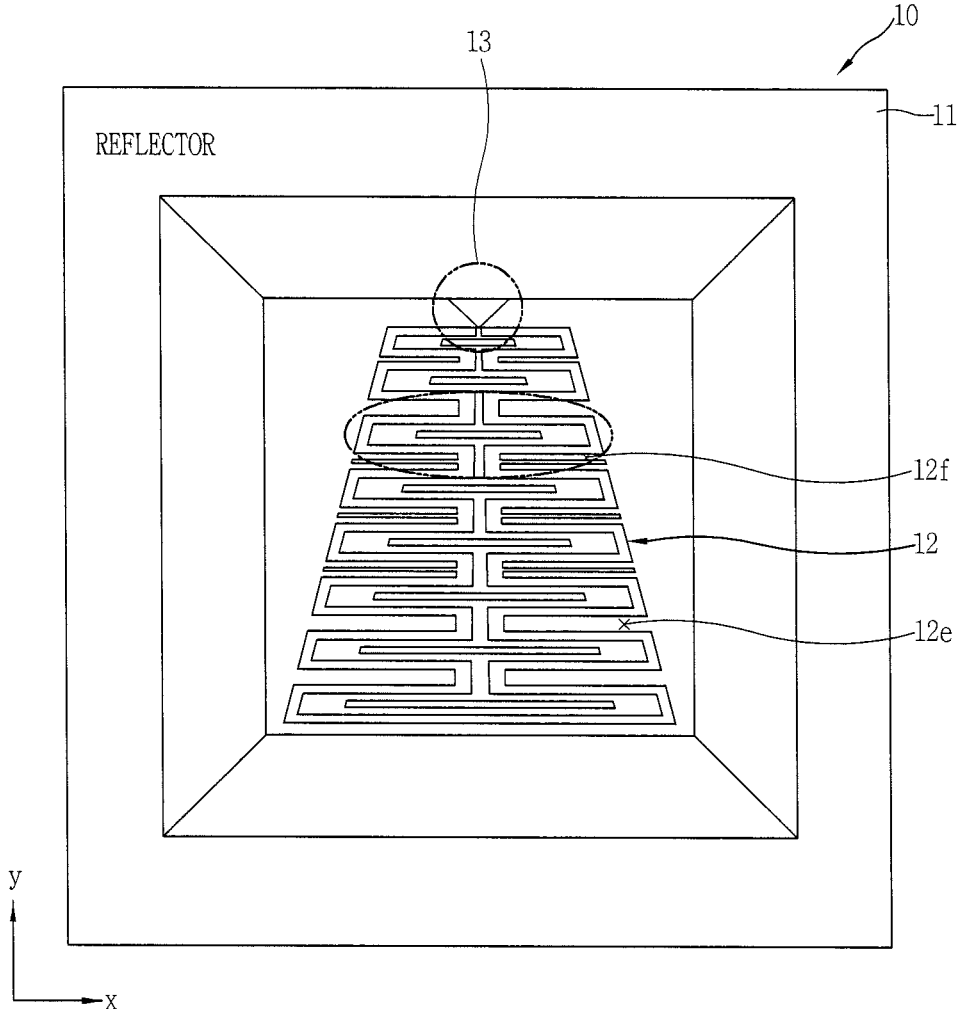
FIG. 3 is a conceptual view illustrating a structure of a log-periodic dipole array antenna having a reflector in accordance with an exemplary embodiment of the present disclosure.
Figure 4:
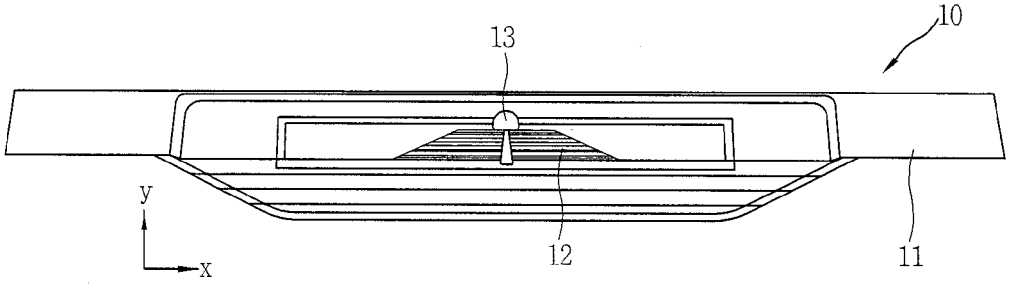
FIG. 4 is a sectional view of FIG. 3.
Figure 5:
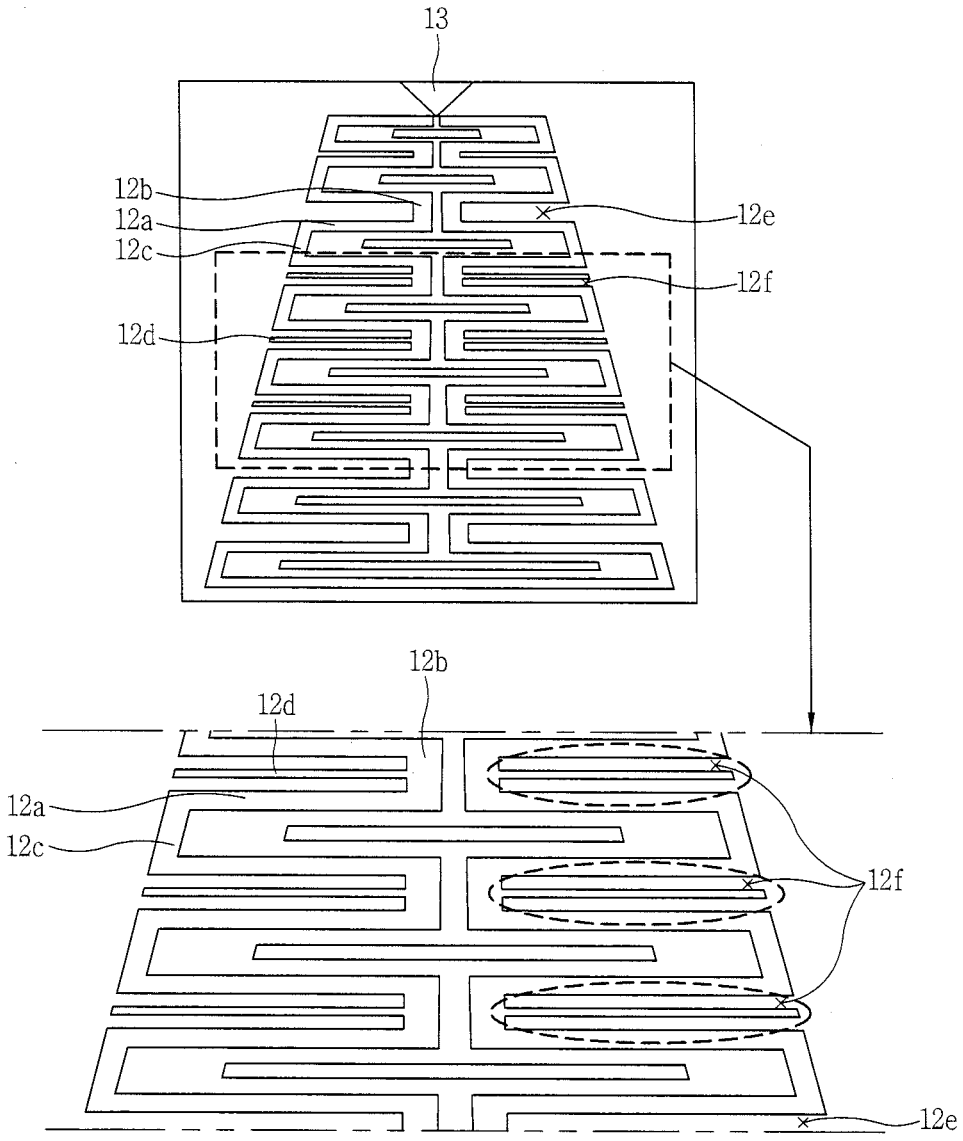
FIG. 5 is an enlarged view of a radiating element of FIG. 3.

FIG. 2 is a conceptual view illustrating a structure of a log-periodic antenna having a reflector, FIG. 3 is a conceptual view illustrating a structure of a log-periodic dipole array antenna having a reflector in accordance with the exemplary embodiment of the present disclosure, FIG. 4 is a sectional view of FIG. 3, and FIG. 5 is an enlarged view of a radiating element of FIG. 3.

FIG. 2 illustrates a log-periodic dipole array antenna without a band stopper, and FIG. 3 illustrates a log-periodic dipole array antenna with the band stopper.

Referring to FIGS. 2 and 3, the log-periodic dipole array antenna may include a dielectric substrate and a radiating element 12 formed on the dielectric substrate. The dielectric substrate may have a predetermined dielectric constant. The dielectric substrate may be implemented as FR-3, which is composed of multiple layers of paper impregnated with an epoxy resin binder, and CEM-1 as a composite material combined with paper core impregnated with epoxy resin. Also, the dielectric substrate may be implemented as CEM-3, FR-4, FR-5, GI, a part of a printed circuit board (PCB) and the like. The CEM-3 impregnated with epoxy resin has woven glass cloth surfaces, and a core of non-woven matte fiberglass. The FR-4 is constructed on multiple plies (layers) of epoxy-resin impregnated woven glass cloth. The FR-5 is constructed on multiple plies of reinforced epoxy-resin impregnated woven glass cloth. The GI is constructed on multiple plies of polyimide-resin impregnated woven glass cloth.

A radiating element 12 may be formed on one surface of the dielectric substrate, and a reflector 11 for adjusting a pattern of a radio frequency (RF) signal radiated from the radiating element 12 may be located on another surface of the dielectric substrate.

Referring to FIG. 5, the radiating element 12 may be made of a conductive material, and have a symmetrical shape based on its center. In more detail, the radiating element 12 may have a shape that lines 12*a* extending to an outer side based on the center are interconnected in the center or the outer side in an alternating manner. That is, the radiating element 12 may include a first connector 12*b* for connecting the lines 12*a* to each other at the center, and a second connector 12*c* for connecting the lines 12*a* at the outer side of the radiating element 12. The lines 12*a* may be gradually longer going from up to down according to the log-periodic ratio. The lines 12*a* and the connectors 12*b* and 12*c* may define slots 12*e* and 12*f*. Sizes or locations of the slots 12*e* and 12*f* may affect the characteristic of the antenna 10. The slots 12*e* and 12*f* may be classified into a log-periodic slot 12*e* and a band stopping slot 12*f*.

A feeding connector 13 for electrically connecting the radiating element 12 to a feeding portion may be formed on an upper side of the radiating element 12. The feeding portion may be configured to feed the radiating element 12 through the electrical connection or in an Electro-Magnetic (EM) feeding manner. To this end, the feeding connector 13 may include at least one of a feeding board, a feeding clip and a feeding line. As one of the feeding board, the feeding clip and the feeding line is electrically connected to another, current (or voltage) supplied from a feeding device is transferred to the radiating element 12 which transceives (transmits and receives) RF signals. Here, the feeding line may include a microstrip printed onto a substrate. The feeding portion may be configured by combination of a balun, a phase shifter, a distributor, an attenuator, an amplifier, and the like.

The radiating element 12 may be fed to resonate in a plurality of frequency bands. Here, if it is assumed that one of low frequency bands is referred to as a first frequency band and one of high frequency bands is referred to as a second frequency band, the radiating element 12 may operate in both of the first and second frequency bands, respectively.

The log-periodic dipole array antenna may have the broadband characteristic but may not have desired antenna gain and radiation efficiency in specific frequencies. Therefore, to selectively use a user-desired frequency, the antenna 10 should be additionally provided with a filter circuit.

However, as illustrated in FIG. 5, upon blocking signals between the first and second frequency bands by formation of a band stopper 12*d*, the gain and radiation efficiency of the antenna 10 may increase in the first and second frequency bands adjacent to each other.

By the formation of the band stopper 12*d*, tuning for impedance mismatching of the antenna 10 may be allowed. That is, the impedance may be mismatched between the first frequency band and the second frequency band by tuning a resistance value as a real number part of the impedance and a reactance value as an imaginary number part of the impedance. In other words, a loss of the antenna 10 may increase and a gain may decrease between the first and second frequency bands, improving the gain of the adjacent frequency bands and reducing the reflection efficiency.

The band stopper 12*d* may be configured as a conductive member which extends from the first connector 12*b* of the radiating element 12 to the exterior. As the conductive member extends between the lines 12*a* configuring the radiating element 12, capacitance of the antenna 10 may be varied. Since the reactance is lowered in response to the variation of the capacitance, the impedance between the first and second frequency bands may be mismatched. That is, since the loss of the antenna 10 increases between the first and second frequency bands, a band stop effect may be obtained.

The band stopper 12*d* may be provided in plurality. The band stoppers 12*d* may have a symmetrical form based on the center of the radiating element 12.

The band stopper 12*d* may be located adjacent to an upper side or a lower side of the radiating element 12 according to which frequency band corresponds to a signal whose frequency characteristic is to be improved.

When the band stopper 12*d* is located above the radiating element 12, the frequency characteristic for a signal in the first frequency band as the lower frequency band may be improved. When the band stopper 12*d* is located below the radiating element 12, the frequency characteristic for a signal in the second frequency band as the high frequency band may be improved.

An inductance value or a capacitance value may be varied by changing a length or location of the conductive member configuring the band stopper 12*d*. That is, the inductance value may increase as the conductive member extends, and the capacitance value may increase as the conductive member is located close to the lines 12*a*.

Figure 6:
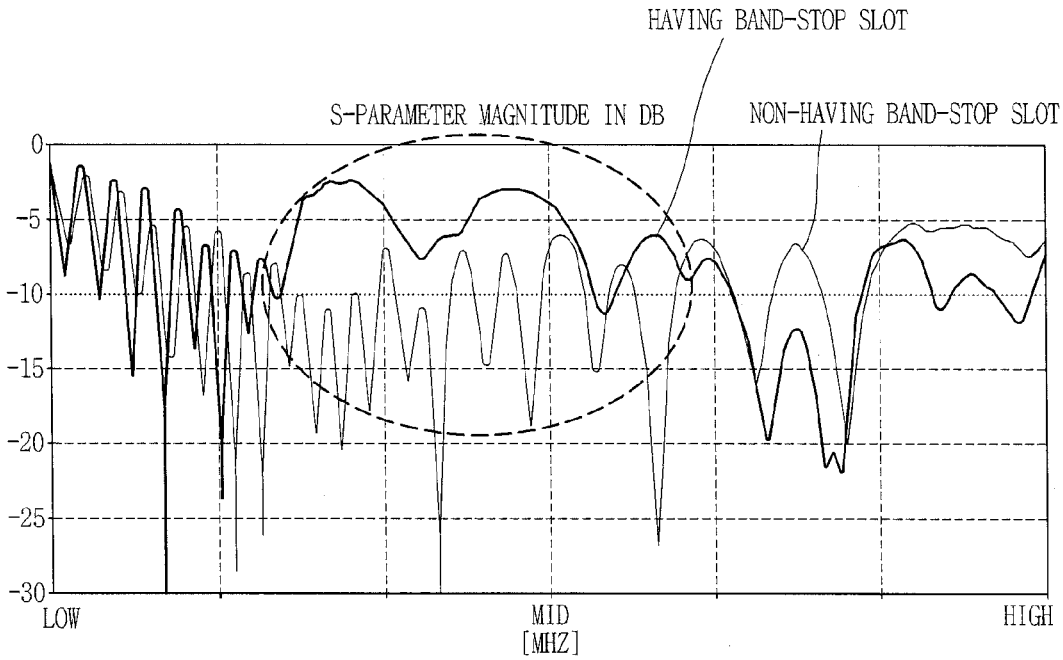
FIG. 6 is a graph showing comparison results of reflection losses between an antenna without a band stopper and an antenna with a band stopper.
Figure 7:
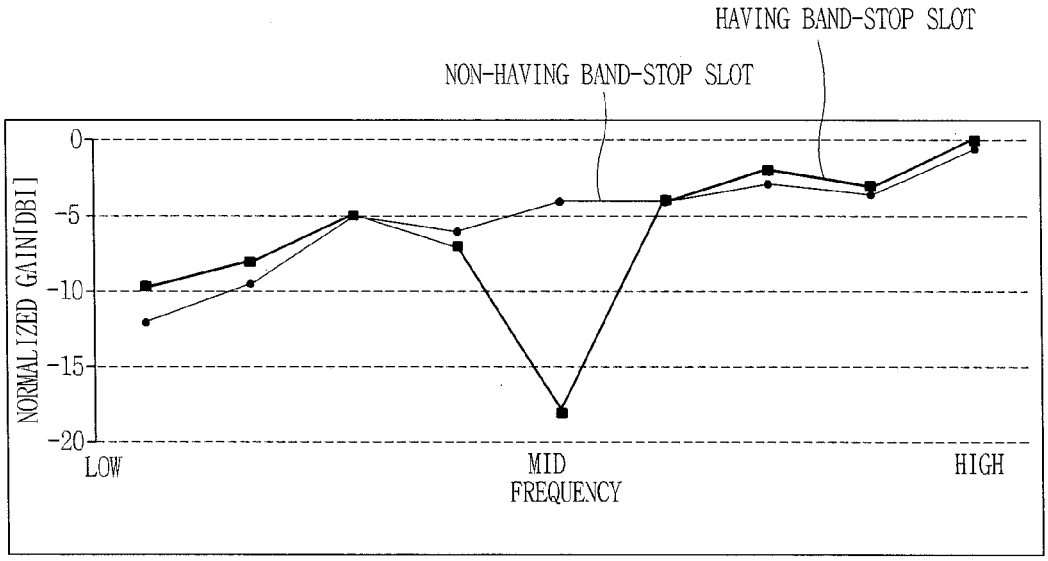
FIG. 7 is a graph showing comparison results of antenna gains between the antenna without the band stopper and the antenna with the band stopper.

FIG. 6 is a graph showing comparison results of reflection losses between the antenna 10 without the band stopper 12*d* and the antenna 10 with the band stopper 12*d*, and FIG. 7 is a graph showing comparison results of antenna gains between the antenna 10 without the band stopper 12*d* and the antenna 10 with the band stopper 12*d*.

As illustrated in FIGS. 6 and 7, it may be noticed that the antenna 10 having the band stopper 12*d* exhibits an increased reflection loss and a reduced gain in a band stop frequency. Also, a reduced reflection loss and an improved gain may be noticed in a frequency band adjacent to the band stop frequency.

As such, the characteristic of the antenna 10 according to the present disclosure in a specific frequency band may be controlled, even without use of a filter, by way of adjusting locations or lengths of the lines 12*a* defining the slots and the length or location of the conductive member configuring the band stopper 12*d*. That is, the present disclosure may allow for multi-band and band separation of the broadband antenna 10.

Figure 8:
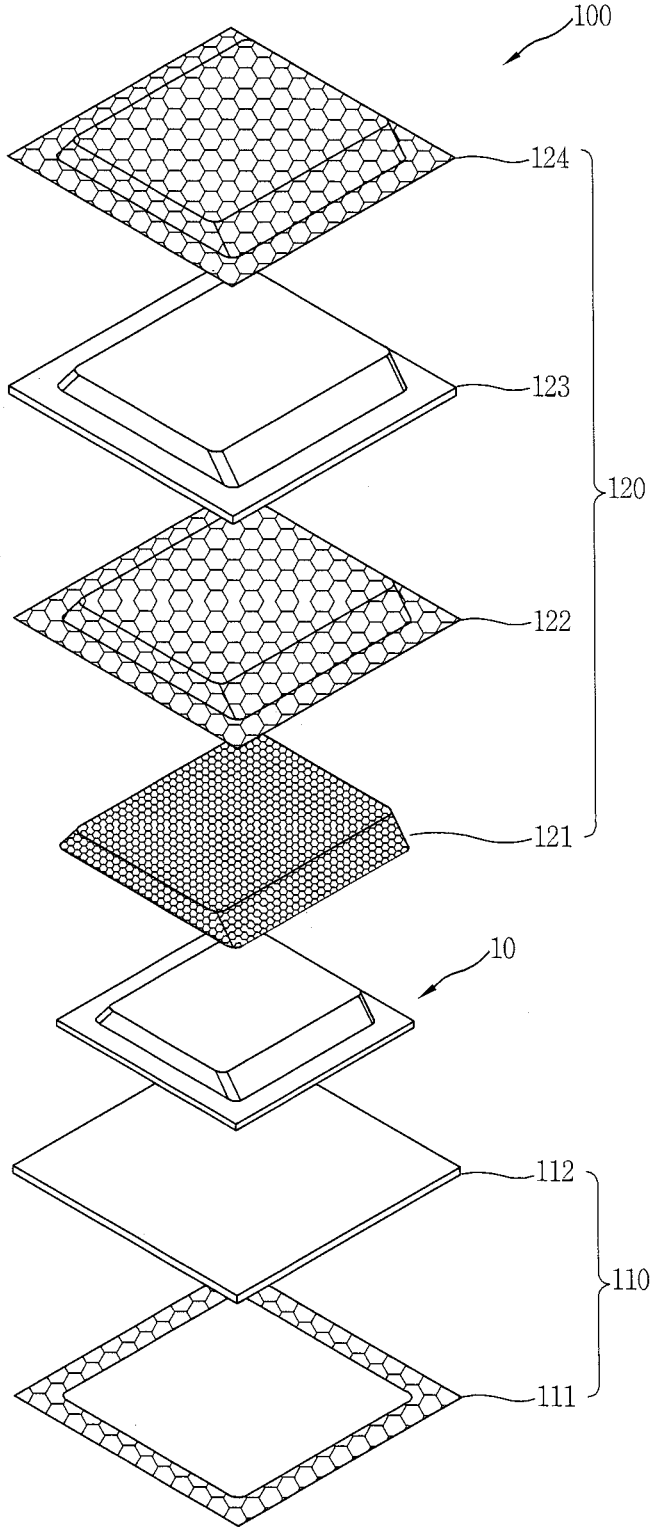
FIG. 8 is a disassembled perspective view illustrating one exemplary embodiment of a smart skin having the antenna according to the exemplary embodiment of the present disclosure.

FIG. 8 is a disassembled perspective view illustrating one exemplary embodiment of a smart skin 100 having the antenna 10 according to the exemplary embodiment of the present disclosure.

A front surface of a smart skin 100 may be an exposed portion to an outside of an aircraft, and have the same curvature as that of a portion of the aircraft, to which the smart skin 100 is mounted. A rear surface of the smart skin 100 may be located inside the aircraft, and be connected with a connector of the antenna 10 and electronic elements for an antenna mounted in the aircraft.

The smart skin 100 may have a different curvature depending on an antenna-mounting position of each aircraft, but a design variation may be allowed according to an appearance of the aircraft. Therefore, a log-periodic slot dipole array antenna may be disposed in the smart skin without causing any problem in arrangement of the antenna. Also, the skin of the aircraft may be processed such that a surface for protecting the antenna can have the same curvature as that of the appearance of the aircraft.

The smart skin 100 according to the exemplary embodiment may include a radar dome (radome) 110 and a supporter 120. The antenna 10 may be disposed between the radar dome 110 and the supporter 120.

The radar dome 110 may be located at the outermost side of the smart skin 100 and have the same outline as an outer surface (appearance) of the aircraft. The radar dome 110 may include a first layer 111 and a second layer 112 laminated on the first layer 111.

The first layer 111 may be exposed to the surface of the aircraft, and the exposed portion may be implemented as a metal mesh, which is designed to protect the smart skin 100 and the antenna 10 from lightning. The second layer 112 may be made of a glass fiber composite material, designed to function as a radome and support an external impact and a weight.

Here, the metal mesh may be electrically connected to an adjacent conductive member, which is formed on a surface of a fuselage of the aircraft such that the lightning toward the fuselage can flow along the surface of the fuselage.

The glass fiber composite material may be formed such that the fiber contained in the composite can have a predetermined orientation angle. When the fibers have the predetermined orientation angle, the glass fiber composite may have rigidity more than a predetermined level against torsion.

The antenna 10 may be an electric performance element of the smart skin 100 which replaces the existing aircraft antenna, and implemented as a log-periodic dipole array antenna 10 which operates in a multi-frequency band.

The supporter 120 may be formed for maximizing the electric performance of the antenna 10 and structurally supporting the smart skin 100. The supporter 120 may be partially recessed into the fuselage in a shape corresponding to the antenna 10 such that the antenna 10 can be mounted. The supporter 120 may be formed by laminating a honeycomb core, a first metal mesh, a glass fiber composite, and a second metal mesh in a sequential manner.

The honeycomb core disposed on a first layer 121 may increase flexural rigidity of the smart skin 100. The honeycomb core may be formed to secure a space required for the performance of the antenna 10. The honeycomb core may execute an electrical function by using NOMEX® (a high temperature resistant aramid paper) core similar to a dielectric constant of air. Also, the first metal mesh may be formed on a second layer 122. The first metal mesh may forwardly reflect a radio frequency (RF) signal, which is rearwardly radiated from the antenna 10. That is, the first metal mesh may be disposed to improve the performance of the antenna 10.

A carbon fiber-reinforced composite for structurally supporting a weight applied to the smart skin 100 may be disposed on a third layer 123. The second metal mesh may be formed on a fourth layer 124. The second metal mesh may forwardly reflect an RF signal, which is rearwardly radiated from the antenna 10. That is, the second metal mesh may be disposed to improve the performance of the antenna 10. The first metal mesh and the second metal mesh may be made of a material including copper.

Hereinafter, description will be given of a method for fabricating a smart skin according to an exemplary embodiment.

The radar dome 110 and the supporter 120 may be formed, respectively (First step). The fabrication may be implemented by co-curing. The co-curing refers to a process of simultaneously executing a bonding process and a curing process when two or more materials are bonded.

The radar dome 110 may be formed by vacuum bag molding. In the vacuum bag molding, a metal mesh may be laminated on a glass fiber composite containing a plurality of fibers arranged with a predetermined orientation angle and processed by applying heat and pressure within an autoclave. Here, the glass fiber composite may be laminated on the metal mesh by a preset laminate angle so as to increase durability with respect to flexural rigidity.

The supporter 120 may be formed by vacuum bag molding. That is, a honeycomb core, a first metal mesh, a glass fiber composite and a second metal mesh may be laminated in a sequential manner and processed by applying heat and pressure within the autoclave.

Afterwards, an adhesive layer may be formed on one surface of the antenna 10 having a connector, and the antenna 10 may be coupled to the supporter 120 (Second step). In more detail, a room temperature setting adhesive may be coated on a surface of the antenna 10 where the connector is visible. The antenna 10 may then be inserted into the honeycomb core surface of the fabricated supporter 120 so as to fabricate a secondary structure of the smart skin.

After forming the adhesive layer on the radar dome 110, the supporter 120 and the radar dome 110 may come in contact with each other in a facing manner by interposing the antenna 10 therebetween, and then be cured (Third step).

In more detail, the room temperature setting adhesive may be fully coated on a surface of the radar dome layer 112, which is opposite to a surface facing the metal mesh. The surface of the secondary structure with the antenna 10 may be aligned to cover the surface coated with the room temperature setting adhesive, and then cured onto each other at room temperature, completing the fabrication of the smart skin.

The method may further include a step of electrically connecting the metal mesh to an adjacent conductive member formed on a surface of a fuselage of an aircraft when coupling the fabricated smart skin to a surface of the fuselage. This may allow lightning, which is falling toward the fuselage of the aircraft, to flow along the surface of the fuselage.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A log-periodic dipole array antenna comprising:

a dielectric substrate;

a radiating element having a plurality of lines extending from a center to an outer side and symmetrically arranged on the dielectric substrate based on the center, so as to resonate in a first frequency band and a second frequency band, the plurality of lines being connected at the center or the outer side of the radiating element in an alternating manner, the lines becoming longer going from up to down of the radiating element fed according to a predetermined log-periodic ratio; and a band stopper selectively formed on either an upper side or lower side of one point for connecting the lines to each other to reduce an antenna gain in a first adjacent frequency band or a second adjacent frequency band, wherein the first frequency band is higher than the second frequency band, and wherein the first adjacent frequency is adjacent to the first frequency band and the second adjacent frequency is adjacent to the second frequency band.

2. The antenna of claim 1, wherein the radiating element comprises a first connector configured to connect the lines at the center of the radiating element, and a second connector configured to connect the lines at the outer side of the radiating element, and wherein the band stopper extends from the first connector toward the outer side.

3. The antenna of claim 2, wherein the band stopper is provided in plurality.

4. The antenna of claim 3, wherein the band stoppers are symmetrically arranged based on the center of the radiating element.

5. The antenna of claim 1, wherein the first frequency band is higher than the second frequency band, and wherein the band stopper is located adjacent to an upper side of the radiating element to reduce antenna gain with respect to a signal adjacent to the first adjacent frequency band.

6. The antenna of claim 5, wherein the first frequency band is higher than the second frequency band, and wherein the band stopper is further located adjacent to a lower side of the radiating element so as to reduce antenna gain with respect to the second adjacent frequency band, wherein the second adjacent frequency band is higher than the second frequency band.

7. The antenna of claim 1, wherein the radiating element is formed on one surface of the dielectric substrate, and wherein a reflector is disposed on another surface of the dielectric substrate to adjust a pattern of a radio frequency signal radiated from the radiating element.

8. A log-periodic dipole array antenna of claim 1, wherein the second frequency band is higher than the first frequency band, and wherein if the band stopper is formed on the upper side, the band stopper both reduces the antenna gain in the first adjacent frequency band and improves a frequency characteristic in the first frequency band, and wherein if the band stopper is formed on the lower side, the band stopper both reduces the antenna gain in the second adjacent frequency band and improves the frequency characteristic in the second frequency band.

9. A smart skin configuring an appearance of a fuselage of an aircraft, the smart skin comprising:

a radar dome exposed to an outside, and having a glass fiber composite material and a metal mesh to cover the glass fiber composite;

a supporter coupled to an inner surface of the radar dome; and an antenna interposed between the radar dome and the supporter, wherein the radar dome has the same curvature as that of a surface of the fuselage of the aircraft to reduce a radar cross section, and wherein the antenna is implemented as a log-periodic dipole array antenna configured to operate in a multi-frequency band, the antenna comprising:

a dielectric substrate;

a radiating element having a plurality of lines extending from a center to an outer side and symmetrically arranged on the dielectric substrate based on the center, so as to resonate in a first frequency band and a second frequency band, the plurality of lines being connected at the center or the outer side of the radiating element in an alternating manner, the lines becoming long going from up to down of the radiating element fed according to a predetermined log-periodic ratio; and a band stopper selectively formed on either an upper side or lower side of one point for connecting the lines to each other to reduce an antenna gain in a first adjacent frequency band or a second adjacent frequency band, wherein the first frequency band is higher than the second frequency band, and wherein the first adjacent frequency is adjacent to the first frequency band and the second adjacent frequency is adjacent to the second frequency band.

10. The smart skin of claim 9, wherein the metal mesh is electrically connected to an adjacent conductive member, formed on a surface of the fuselage, such that lightning falling toward the fuselage flows along the surface of the fuselage.

11. The smart skin of claim 9, wherein the supporter is recessed into the fuselage in a shape corresponding to the antenna so as to receive the antenna.

12. The smart skin of claim 11, wherein the supporter is formed by laminating a honeycomb core, a first metal mesh, a glass fiber composite, and a second metal mesh in a sequential manner.

13. The smart skin of claim 12, wherein the honeycomb core is disposed between the antenna and the first metal mesh.

14. The smart skin of claim 12, wherein the first metal mesh and the second metal mesh are formed of copper such that radiation of the antenna is performed toward an outside of the aircraft.

15. The smart skin array antenna of claim 9, wherein the second frequency band is higher than the first frequency band, and wherein if the band stopper is formed on the upper side, the band stopper both reduces the antenna gain in the first adjacent frequency band and improves the frequency characteristic in the first frequency band, and wherein if the band stopper is formed on the lower side, the band stopper both reduces the antenna gain in the second adjacent frequency band and improves the frequency characteristic in the second frequency band.

* * * * *